United States Patent [19]

Jenness

[11] Patent Number: 4,648,561

[45] Date of Patent: Mar. 10, 1987

[54] GRINDING MILL APPARATUS

[75] Inventor: Raymond C. Jenness, Delafield, Wis.

[73] Assignee: Allis-Chalmers Corporation, Milwaukee, Wis.

[21] Appl. No.: 761,996

[22] Filed: Aug. 2, 1985

[51] Int. Cl.[4] ..... B02C 25/00

[52] U.S. Cl. ..... 241/34

[58] Field of Search ..... 241/30, 33, 34, 35, 241/37, 299, 179, 182, 183, 284, 26

[56] References Cited

U.S. PATENT DOCUMENTS

| | | | |
|---|---|---|---|
| 3,253,744 | 5/1966 | MacPherson et al. | 241/34 X |
| 3,471,094 | 10/1969 | Kearney et al. | 241/34 X |
| 4,251,035 | 2/1981 | Chatwin et al. | 241/37 |

FOREIGN PATENT DOCUMENTS

| | | | |
|---|---|---|---|
| 914823 | 1/1963 | United Kingdom | 241/34 |

*Primary Examiner*—Mark Rosenbaum

*Attorney, Agent, or Firm*—Arthur M. Streich; Timothy R. Conrad

[57] ABSTRACT

A grinding mill apparatus is disclosed comprising a grinding mill having a feed end head and a discharge end head and a shell disposed between said heads and secured thereto for rotation with the head. A feed end bearing and a discharge end bearing are provided for supporting the feed end head and the discharge end head for rotation about a generally horizontal axis. The bearings include a bearing element which pivots with the heads with the amount of pivot proportional to the increase or decrease of charge level within the mill. A proximity probe is secured to a stationary surface and aligned with a target which is secured to the bearing. The proximity probe detects changes in gap size between the probe and the target and generates a signal indicating an increase in charge level or a decrease in charge level within the mill. The reading from the proximity probe together with a reading of power requirements for the mill indicate whether a charge level within a mill is approaching a maximum operating charge level for the mill.

4 Claims, 6 Drawing Figures

GRINDING MILL APPARATUS

BACKGROUND OF THE INVENTION

1. Field of the Invention

This invention pertains to grinding mills and, more particularly, the invention pertains to a grinding mill with means for monitoring changes in the charge load of a grinding mill.

2. Description of the Prior Art

In the prior art, grinding mills are well known for grinding a variety of ores. It is desirable to monitor the amount of change in the charge load within a rotary grinding mill compartment. This is especially true for autogenous mills or semi-autogenous mills. As is apparent to those in the art, autogenous mills are mills where the ore itself is the grinding medium. In semi-autogenous mills, the grinding action is supplied by the ore and an additional medium such as steel balls. Since the inception of autogenous grinding mills, the art has been looking for means for measuring the amount of charge load in the mill compartment.

One method of measuring the amount of charge load in a grinding mill compartment is to measure the amount of power consumed by the grinding mill during operation. As the charge load increases, the power requirements for the mill increases. However, one very important phenomena occurs which makes monitoring of power an ineffective method of determining the amount of charge load in the mill compartment. For example, as the charge load approaches approximately 40 to 50% of the capacity of the mill, the power requirements for the mill actually level off and decrease. This is attributable in part to the fact that the tumbling action of the material within the mill compartment may assist in rotation of the mill. An accurate determination of the power requirements is important since the load is fed to the mill according to the power requirements. That is, a hard material is fed at slow rates since a high power requirement is needed to grind the hard material. A softer material is fed at a faster rate. Material is discharged continuously from the mill after it is ground. Therefore, the variation of charge in the mill compartment can occur continuously throughout operation of the mill.

Other methods of determining changes in charge load within the mill include measuring pressure of a lubricant between the mill trunnion and support bearing. However, this is not an accurate measure of the load in the compartment since the pressure of the hydrodynamic lubricant between the trunnion and the bearing is in part a function of the lubricant temperature. Another method for determining the charge load was to place load cells underneath main bearing assemblies. However, this is not successful since not all of the load is taken up by the load cell and some is taken up by the bearing base. As a result, it is not readily distinguishable what percentage is taken up by the load cells. Therefore, the amount measured by the load cells cannot be reasonably correlated with the amount of charge load within the mill compartment.

OBJECTS AND SUMMARY OF THE PRESENT INVENTION

It is an object of the present invention to provide a grinding mill apparatus with means for determining changes in charge load within the mill compartment.

It is a further object of the invention to provide a grinding mill apparatus with means for measuring deflections of apparatus equipment which deflect in response to charge load within the mill compartment.

A yet further object of the present invention is to provide a grinding mill apparatus with a proximity probe having a target secured to an element of the grinding mill apparatus which deflects in response to charge load within the compartment and a sensor which determines changes in distance between the target and the sensor.

According to a preferred embodiment of the present invention, there is provided a grinding mill apparatus having a trunnion supported on a bearing insert. The trunnion deflects which in turn causes the bearing insert to deflect from a predetermined mill empty position. The amount of deflection is essentially proportional to the amount of charge load within the grinding mill compartment. A proximity probe is provided with a target rigidly secured to the bearing insert and with a sensor rigidly secured to a stationary frame and aligned with the target. As charge level within the mill changes, a gap between the sensor and the target varies with the sensor detecting the change in the gap and providing an indication of change in the charge level.

DESCRIPTION OF THE PREFERRED EMBODIMENTS

Figure 1:
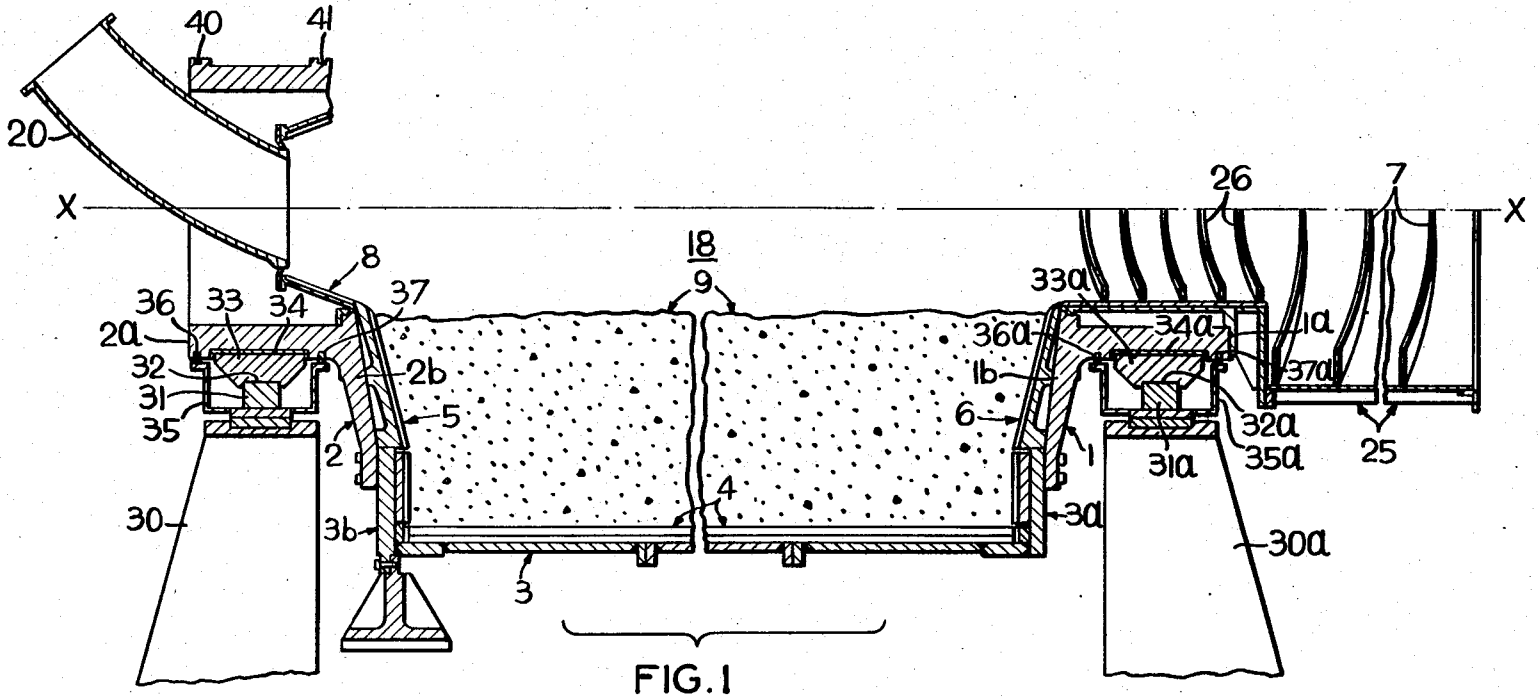
FIG. 1 is a cross-sectional view taken in elevation of a grinding mill apparatus.

Referring to FIG. 1, a grinding mill is shown. In FIG. 1, the rotating elements of the mill are only shown as they appear below the horizontal axis of rotation X—X. The rotary elements of the mill are symmetrical about axis X—X. The mill includes a discharge end head 1 and a feed end head 2. As shown, head 1 and head 2 are comparable and consist of tubular head members 1*a* and 2*a* having axially aligned bores and radial flanges 1*b* and 2*b* extending from the head members. The head members 1 and 2 have their bores axially aligned in a generally horizontal axis of rotation X—X. Secured to the head members 1 and 2 for rotation therewith is a cylindrical shell 3 which is secured to the discharge end head 1 by means of an end plate 3*a* and is secured to a feed end head 2 by means of an end plate 3*b*. End plates 3*a* and 3*b*, discharge end head 1, feed end head 2 and shell 3 are combined to rotate about the horizontal axis passing through the axes of the bores of the heads 1 and 2. Also, these members cooperate to define a mill chamber 18 in which an ore to be ground is fed. Before ore is admitted into the chamber, the chamber is first provided with liners such as cylindrical liners 4 and radial liners 5 and 6. These liners protect the discharge end head 1, feed end head 2, shell 3 and end plates 3*a* and 3*b* from abrasion due to the tumbling and grinding action of the charge within the mill compartment.

Ore is admitted into the compartment by means of a feed spout 20 which does not rotate and passes feed from a source into a rotary chamber defined by a liner 8 into the mill where the charge assumes a level 9. The discharge end of the mill includes a trommel 25 which is provided with a plurality of reversing spirals 26. As the mill rotates around the horizontal axis, charge which would otherwise tend to migrate out through the discharge end is forced back into the mill by means of the reversing spirals 7. The reversing spirals 7 do not interfere with discharge on a rather continuous basis of ground ore from the mill. Accordingly, during operation of the mill when the shell 3 and attached items are rotating, feed is being supplied to the mill at a generally continuous rate and ground ore is being discharged from the mill at a generally continuous rate.

The mill is supported for rotation about the horizontal axis X—X by means of a feed end bearing and discharge end bearing. Both the feed end bearing and the discharge end bearing are alike and a description of one will suffice as a description of both. Similar items between the feed end and discharge end bearings receive identical numeral designations except that the discharge end bearings will be followed by a lower case "a".

Figure 4:
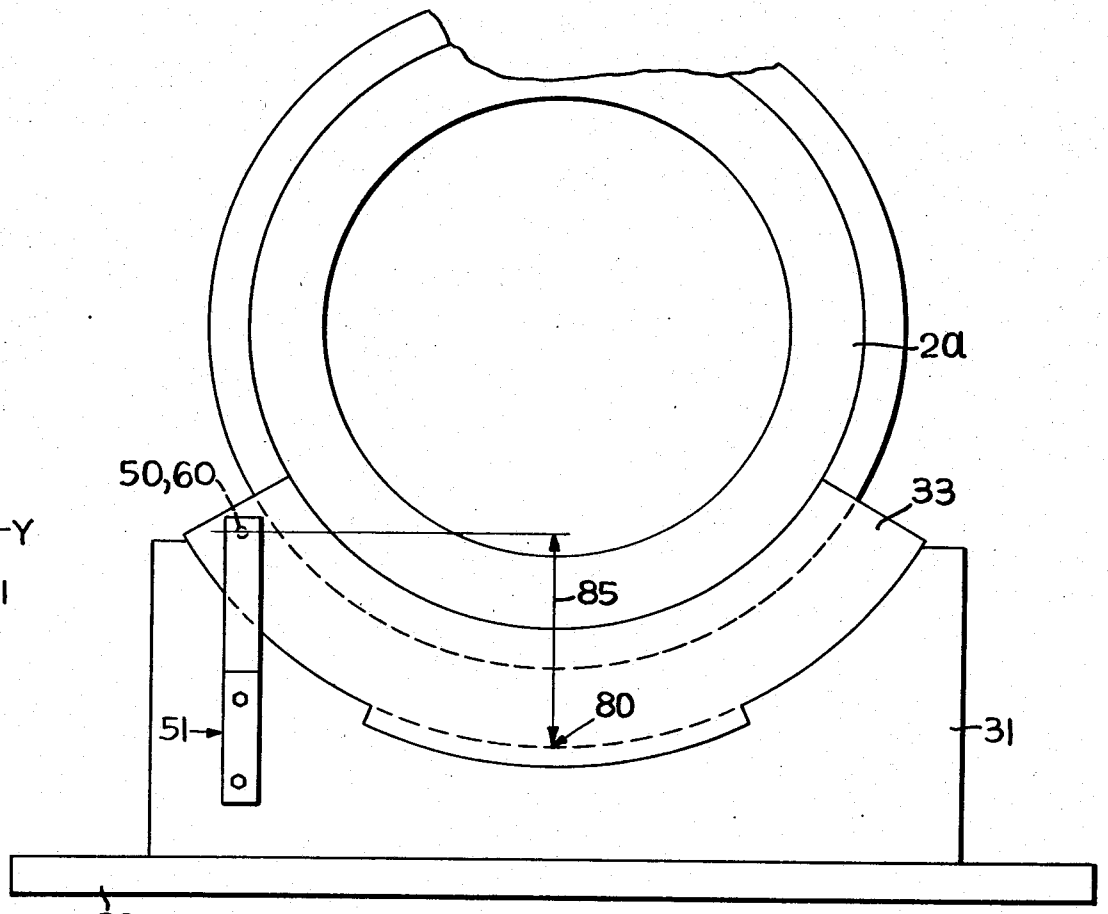
FIG. 4 is an end view of a grinding mill according to the present invention having a detector.

The bearings comprise a bearing support 30 which is secured to a stationary foundation. Resting on the upper surface of the bearing support is a bearing base 31 which has a generally cylindrical horizontal upper surface 32. A bearing insert 33 is provided which rests on the bearing base 31. An upper surface 34 of the bearing insert is generally cylindrical in a direction coaxial with the horizontal axis of rotation and has a generally circular arc when viewed in a line colinear with the axis such as shown in FIG. 4. The bearing insert 33 is provided resting on the bearing base 31 with the insert 33 aligned to receive in bearing engagement an outer cylindrical surface of the tubular portion of the trunnion head. As known in the art, the portion of the outer cylindrical surface which engages the bearing insert 33 at any given time is referred to as the trunnion.

A housing 35 surrounds the bearing insert 33 and bearing base 31 and has sealing elements 36 and 37 which are received into radial slots 40 and 41 of the tubular portion 2*a* such that the housing defines a compartment in which the bearing insert 33 and bearing base 31 are received protected from dust and other contaminants in the environment of the mill. The housing is provided with a level of oil which during operation of the mill migrates between the trunnion and surface 34 of the bearing insert to provide a lubricant between the rotating head and the stationary insert. Bearings such as those described above are well known in the art. The load within the grinding mill will cause an angular deflection of the trunnion from horizontal (shown exaggerated as angle A in FIG. 2). If the bearing surface were to be fixed in a horizontal plane, the angular deflection of the trunnion and the surface of the bearing would provide a wedge-shaped lubricant film between the bearing and the trunnion. By providing the bearing insert being positionable on the bearing base, the bearing insert may rock on the bearing base such that it follows the trunnion and, therefore, there is constantly a uniform thickness of lubricant between the bearing surface 34 and the trunnion. I have determined that this deflection of the trunnion, together with the following rocking of the bearing insert, can be utilized to provide an indication of the change in load within the mill compartment.

Figure 2:
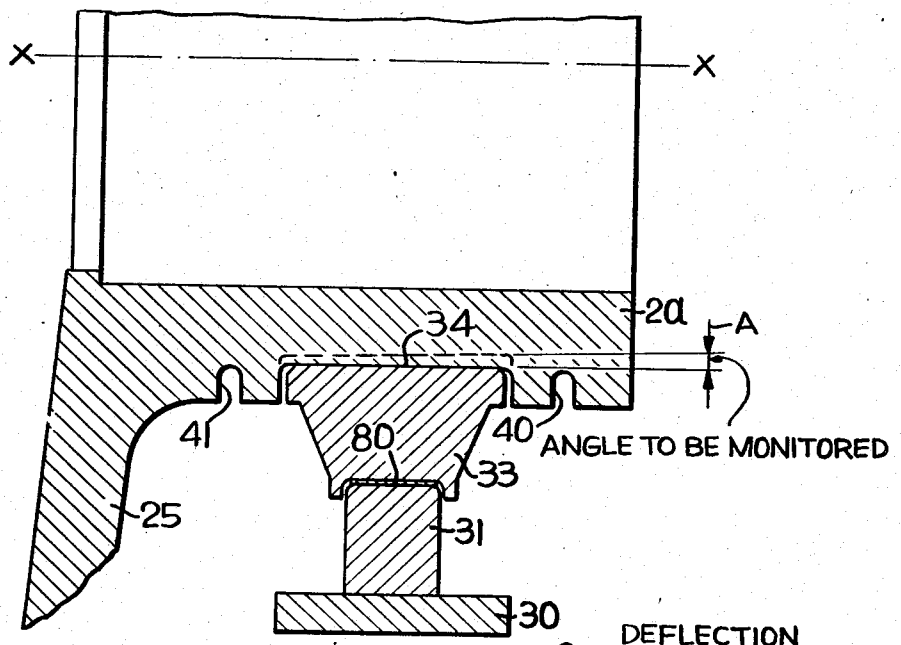
FIG. 2 is a view taken in elevation of a grinding mill trunnion supported on a bearing showing an exaggerated deflection angle resulting from a charge load within the mill compartment.

FIG. 2 shows how the trunnion deflects from horizontal by reason of a load within the mill. The angle of deflection A shown within FIG. 2 is exaggerated. When the trunnion deflects the angle shown in FIG. 2, the bearing insert 33 will rock on the bearing base 31 with the bearing insert upper surface 34 following the trunnion such that the trunnion surface and the bearing insert upper surface 34 remain parallel with a uniform thickness of lubricant between the two. The bearing insert 33 rocks on the bearing base 31 at pivot point 80. I have determined that the amount of the angle of deflection of the trunnion and the bearing insert surface 34 is essentially proportional to the total load imposed on the mill. Indeed, I have determined that on a feed end of a mill such as a ROCKCYL mill, as manufactured by the Allis-Chalmers Corporation, which has a bearing pressure of 284 psi, a differential deflection of 0.050 inches occurs along a thirty-six inch trunnion length. I have determined that since this deflection is proportional to the total load imposed upon the mill, this deflection can be used to determine changes in the load level within the mill and provide a more reliable determination of changes of load within the mill than would be available through analyzing power requirements alone or is available through prior art techniques of measuring the load such as measuring the pressure of the lubricant between the bearing surface 34 and the trunnion or in providing load cells for the bearing.

Figure 3:
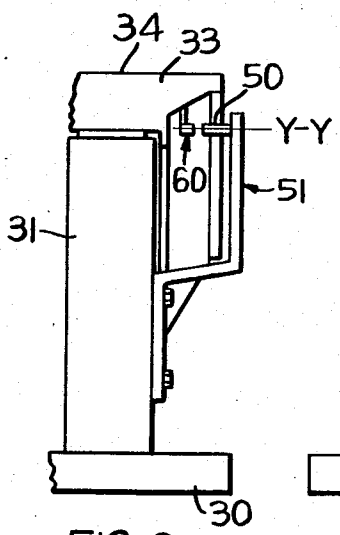
FIG. 3 is a view of a detection apparatus for the grinding mill of the present invention.

Referring to FIGS. 3 and 4, a deflection measuring device in the form of a proximity probe 50 is provided secured to a support arm 51 which is in turn rigidly secured to the bearing base 31. The support arm 51 is sized such that the proximity probe 50 is mounted with its axis Y—Y in an axial direction. A target 60 is secured rigidly to the bearing insert 33 such that the target is axially aligned with proximity probe 50. As shown in FIG. 4, both the target 60 and proximity probe 50 are positioned such that they face one another at a position approximately 60° upward in a clockwise direction when viewed from FIG. 4 from the pivot point 80 of the bearing insert 33 on the bearing base 31. This permits positioning of the probe 50 and target 60 at an end of the bearing insert 33 which provides the greatest radial dimension indicated at 85 between the pivot point 80 and the proximity probe 50.

With the probe aligned over the target 60 as shown in FIGS. 3 and 4, as the load within the compartment increases, the angle of deflection between the trunnion and bearing insert surface 34 will increase as the bearing insert 33 rocks on the bearing base 31 at pivot 80. As the angle of divergence increases, the gap between the target 60 and the proximity probe 50 will increase. The proximity probe 50 will detect the fact that the gap is increasing and will generate a signal to an operator that the gap is increasing. During operation of the mill, if an operator gets a signal from the proximity probe 50 that the gap is increasing indicating an increase of load within the mill, and if the operator simultaneously gets a reading that power consumption for the mill is dropping, the operator will then be able to deduce that the mill load is reaching a point of approximately 50% at which point mill operation would become inefficient and the large amount of charge load in the mill would apply an abnormal stress to the rotating elements. Accordingly, by use of the detection device, an operator can perceive this situation occurring and can reduce the amount of feed being supplied to the mill until the mill has generated enough ground ore and discharged the ground ore such that the charge level 9 within the mill is well below the 50% maximum.

In the preceding paragraph, it was stated that as the load within the mill increases, the gap between the proximity probe 50 and the target 60 will increase. This is true if the probe and target are located on an outer end of the bearing insert 31. For example, if the probe and the target are located on the left-hand side, as viewed in FIG. 1, of the bearing insert 33, an increase of load within the mill will result in increase of the gap between the target and the proximity probe 50. However, if the target 60 and probe 50 are positioned at an inside end of the bearing insert 33 (that is secured to the right-hand side of the left-hand bearing insert 33 as viewed in FIG. 1), then an increase in the load will result in a decrease in the gap. Positioning of the target 60 and proximity probe 50 on either side of the bearing insert 33 does not affect its operation in principle and simply means that the logic of operation is reversed depending on how the detector is arranged on the bearing insert. Note that the arm 51 can be reversed such that the target 60 is located on the base block 31 and the arm 51 is fastened to the insert 33. The gap to be monitored would then be located at the lower area of the base block 31. It will be appreciated the proximity probes and signal generators are well known in the art. Such probes are available through several commercial sources including Bently-Nevada of Minden, Nev.

Figure 5:
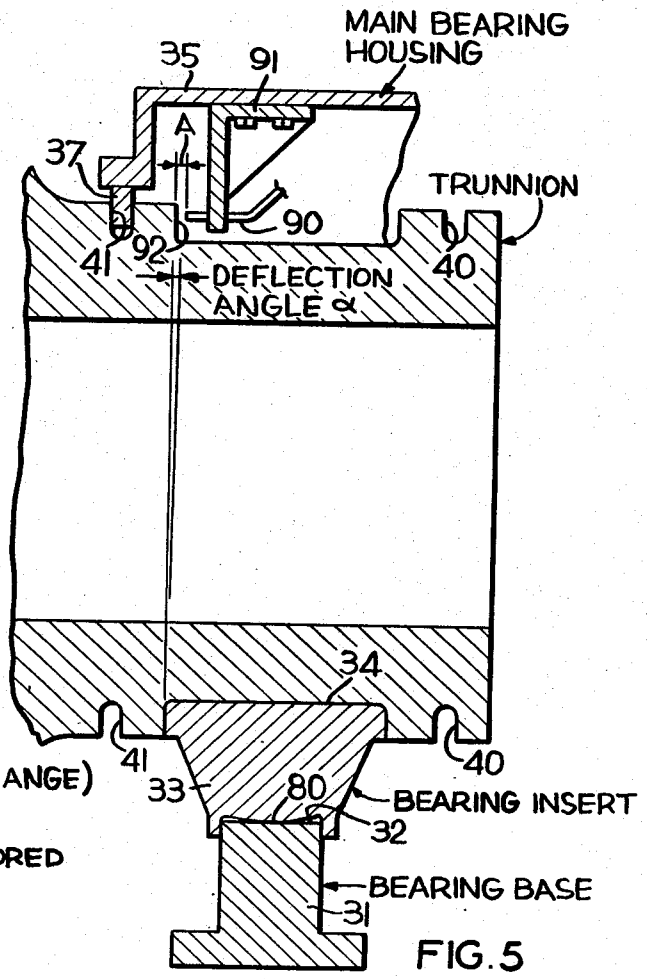
FIG. 5 is a showing of an alternative embodiment of the present invention showing a trunnion supported on a bearing with a proximity probe for detecting the gap between the proximity probe and a surface of the trunnion head.

FIG. 5 is a showing of an alternative embodiment of the present invention. In FIG. 5, a proximity probe 90 is secured by means of an L-shaped bracket 91 to an upper surface of the bearing housing 35. The proximity probe is positioned adjacent a shoulder 92 formed on the trunnion head. The main bearing housing 35 is rigidly secured to the bearing support 30. In the showing of FIG. 5, the seal 37 extending from the main bearing housing is shown extending into the radial groove 41 of the trunnion head. However, these seals do not provide any rigid connection between the housing and the trunnion head and the two are free to move relative to one another. As load within the mill compartment increases, the trunnion head will deflect from a vertical plane an angle as exaggerated and shown as angle A in FIG. 5. As the load increases, the angle will increase and the gap between the proximity probe 90 and the shoulder 92 will increase. This increase in gap will be detectable by the proximity probe and a signal sent to an operator for use as described before.

Figure 6:
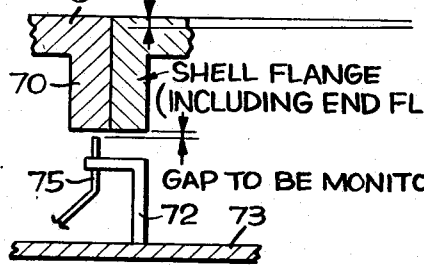
FIG. 6 is a second alternative embodiment of the present invention.

FIG. 6 shows a yet further alternative embodiment of the present invention. With reference to FIGS. 1 and 6, it can be seen that the shell 3 is comprised of a plurality of plates which are joined together at flanges such as at 70. In the embodiment of FIG. 6, a proximity probe 75 is secured by means of an L-shaped bracket 72 to a stationary support 73. The proximity probe 75 is provided facing a lower horizontal surface of the flange element 70. As the load within the mill increases, the gap between the horizontal flange surface and the proximity probe will be decreased and a corresponding signal will be generated indicating to an operator that the load is increasing within the mill.

It can be seen from the foregoing, that the present invention provides a grinding mill apparatus were changes in the charge load within the mill can be readily detected by means of a gap detector such that an operator of the mill can determine by reference to a signal generated by the gap detector that the charge load is either increasing or decreasing. Use of this information together with available information during operation (such as power consumption) can permit an operator to determine if the charge load within the mill is increasing to a point that counterbalance effect will occur and the power required for mill rotation will decrease. When this occurs, the mill operation would otherwise be inefficient. Without the present invention, if a power decrease occurred, an operator would not be able to know whether or not this is due to a charge load approaching the maximum or if the charge load itself were decreasing. The combined information of the feedback from the proximity probe and the power consumption will permit an operator to know with relative certainty that either the charge load is approaching its maximum level or is decreasing. If the charge load increases and the power decreases, the critical load point has been attained and it is necessary for an operator to reduce the feed rate to the mill to reestablish an equalibrium charge. Note that further instrumentation of this signal can allow automatic adjustment of feed rate.

From the foregoing detailed description of the present invention, it has been shown how the objects of the present invention have been obtained in a preferred manner. However, modifications and equivalents of the disclosed concepts such as readily occurred to those skilled in the art are intended to be included in the scope of this invention. Thus, the scope of the invention is intended to be limited only by the scope of the claims such as are, or hereafter may be, appended hereto.

The embodiments of the invention in which an exclusive property or privilege is claimed are defined as follows:

1. A grinding mill apparatus comprising components which include:

(a) a cylindrical mill shell (3) arranged with a central axis (X—X) therethrough being generally horizontal and said shell having a material feed end and a material discharge end with each said end enclosed by a head plate (1, 2), a trunnion (**1*a*, 2*a***) projecting axially outward from each head plate and defining a passage extending centrally therethrough;

(b) a support bearing assembly for each trunnion bearing (**1*a*, 2*a*) with each bearing assembly having a base (31, 31*a*) for mounting on a stationary support structure (30, 30*a*), an insert (33) between each said base (31, 31*a*) and each said trunnion (1*a*, 2*a*) with each said insert having an upper surface (34) concentric to said trunnion (1*a*, 2*a*) and supporting a said trunnion along the axial length of said upper surface (34), and each said insert having a downwardly facing bearing surface which is convex in a vertical plane through said central axis (X—X) and rockably engages said base (31, 31*a*) for rocking movement in said vertical plane about a pivot point (80) intermediate the axial ends of each said insert (33) when a level of material in said shell (3) deflects said shell, head plates and trunnions in said vertical plane; and (c) a proximity probe (50, 75 or 90) rigidly connected to a selected one of said components which is at all times stationary (i.e., 31, 35 or 73) and with said proximity probe adjacently spaced from and aimed at a target portion of a selected one of said components which deflects in response to a change in the level of material within said mill shell (i.e., 60–33, 92 or 70**), with said proximity probe operable to monitor the size of a gap between said proximity probe and said target portion and generate a control signal when a change in gap size occurs and thereby indicate a deviation of the level of material within said mill shell from a predetermined and selected material level.

2. A grinding mill apparatus according to claim 1 wherein said proximity probe (50) is secured to an arm (51) and said arm is secured to said bearing base (31), and a target element (60) is secured to said bearing insert (31) and spaced away from said probe to define between said target element (60) and said proximity probe the variable size gap which indicates the material level within the mill shell.

3. A grinding mill apparatus according to claim 1 wherein said bearing assembly is provided with a stationary bearing housing (35) surrounding said bearing base (31) and said insert (33) and said housing (35) engages one of said trunnions (1*a*, 2*a*) axially outboard and inboard of said bearing insert (33), said one trunnion having a radial surface (92 in FIG. 5) perpendicular to an axis (X—X) central of said shell (3), a bracket (91 in FIG. 5) secured to said housing (35) and supporting said proximity probe (90 in FIG. 5) adjacently spaced from and aimed at a target portion of said radial surface (92) to thereby define the variable size gap which indicates the material level within the mill shell.

4. A grinding mill apparatus according to claim 1 wherein said mill shell (3) comprises sections joined with flanges (70 in FIG. 6) projecting radially outward from said sections, a bracket (72) for connection to stationary support structure (73) and supporting said proximity probe (75) in fixed position beneath said shell (3) and adjacently spaced from and aimed at a target portion of said flanges (70) to thereby define the variable size gap which indicates the material level within the mill shell.

* * * * *